US011396709B2

(12) United States Patent
Jung et al.

(10) Patent No.: US 11,396,709 B2
(45) Date of Patent: Jul. 26, 2022

(54) ELECTRODE FOR ELECTROLYSIS AND PREPARATION METHOD THEREOF

(71) Applicant: LG CHEM, LTD., Seoul (KR)

(72) Inventors: Jongwook Jung, Daejeon (KR); Gyo Hyun Hwang, Daejeon (KR); Jungup Bang, Daejeon (KR); Yongju Bang, Daejeon (KR); Dongchul Lee, Daejeon (KR); Yeonyi Kim, Daejeon (KR); Heejun Eom, Daejeon (KR); Myunghun Kim, Daejeon (KR)

(73) Assignee: LG CHEM, LTD., Seoul (KR)

( * ) Notice: Subject to any disclaimer, the term of this patent is extended or adjusted under 35 U.S.C. 154(b) by 359 days.

(21) Appl. No.: 16/328,224

(22) PCT Filed: Jul. 30, 2018

(86) PCT No.: PCT/KR2018/008645
§ 371 (c)(1),
(2) Date: Feb. 25, 2019

(87) PCT Pub. No.: WO2019/031753
PCT Pub. Date: Feb. 14, 2019

(65) Prior Publication Data

US 2019/0211464 A1 Jul. 11, 2019

(30) Foreign Application Priority Data

Aug. 11, 2017 (KR) ..... 10-2017-0102524
Jul. 27, 2018 (KR) ..... 10-2018-0087750

(51) Int. Cl.
*C25B 11/095* (2021.01)
*C25B 11/02* (2021.01)
(Continued)

(52) U.S. Cl.
CPC ..... *C25B 11/095* (2021.01); *C23C 18/08* (2013.01); *C25B 11/02* (2013.01); *C25B 11/057* (2021.01); *C25B 11/061* (2021.01); *C25B 1/46* (2013.01)

(58) Field of Classification Search
CPC ..... C23C 18/08
See application file for complete search history.

(56) References Cited

U.S. PATENT DOCUMENTS 3,710,473 A 1/1973 McElwain et al.
4,690,840 A 9/1987 Gauthier et al.
(Continued)

FOREIGN PATENT DOCUMENTS

CN 101861412 10/2010
CN 102762776 10/2012
(Continued)

*Primary Examiner* — Robert A Vetere
(74) *Attorney, Agent, or Firm* — Dentons US LLP

(57) ABSTRACT

Provided is an electrode for electrolysis and a preparation method of the same. The electrode for electrolysis has an improved needle-like structure of a rare earth metal compared to conventional electrodes, and thus detachment of catalytic materials is reduced, so that the electrode is excellent in durability such as exhibiting stable performance even in a reverse current flow. Further, since the electrode for electrolysis has a low overvoltage value, an overvoltage required amount of the electrolytic cell can be remarkably reduced. In addition, an electrode for electrolysis having the above effect can be prepared without introducing additional precursors or changing manufacturing facilities.

11 Claims, 2 Drawing Sheets

(51) Int. Cl.

| | |
|---|---|
| ***C25B 11/057*** | (2021.01) |
| ***C25B 11/061*** | (2021.01) |
| ***C23C 18/08*** | (2006.01) |
| ***C25B 1/46*** | (2006.01) |

(56) References Cited

U.S. PATENT DOCUMENTS

| | | | | |
|---|---|---|---|---|
| 7,959,774 | B2 * | 6/2011 | Nara | C25B 11/093 204/290.1 |
| 2003/0008157 | A1 * | 1/2003 | Shiho | C07F 15/0046 428/457 |
| 2006/0042937 | A1 * | 3/2006 | Kaneda | C25B 11/00 204/293 |
| 2007/0269991 | A1 * | 11/2007 | Jang | B82Y 15/00 438/778 |
| 2008/0099328 | A1 | 5/2008 | Arimoto | |
| 2009/0223815 | A1 * | 9/2009 | Nara | C25B 11/093 204/292 |
| 2010/0236937 | A1 | 9/2010 | Rosvall et al. | |
| 2011/0269015 | A1 | 11/2011 | Cho et al. | |
| 2012/0305389 | A1 | 12/2012 | Nara et al. | |
| 2012/0308719 | A1 * | 12/2012 | Wu | C23C 18/08 427/125 |
| 2015/0259811 | A1 * | 9/2015 | Takeuchi | C23C 18/06 427/125 |

FOREIGN PATENT DOCUMENTS

| | | |
|---|---|---|
| CN | 104937142 | 9/2015 |
| JP | S48-015151 | 2/1973 |
| JP | S48-15151 B | 5/1973 |
| JP | S49-045222 | 4/1974 |
| JP | S49-45222 B | 12/1974 |
| JP | H07107861 | 11/1995 |
| JP | H0815151 | 1/1996 |
| JP | H08269763 | 10/1996 |
| JP | H0945222 | 2/1997 |
| JP | H11140680 | 5/1999 |
| JP | H11229170 | 8/1999 |
| JP | 2001348296 | 12/2001 |
| JP | 2003277966 | 10/2003 |
| JP | 2006-097122 | 4/2006 |
| JP | 2006097122 | 4/2006 |
| JP | 2007100159 | 4/2007 |
| JP | 2008-133532 | 6/2008 |
| JP | 4200265 | 12/2008 |
| JP | 2009-215580 | 9/2009 |
| JP | 2009215580 | 9/2009 |
| JP | 2012-180597 | 9/2012 |
| JP | 2013166994 | 8/2013 |
| JP | 5681343 | 3/2015 |
| JP | 2015143388 | 8/2015 |
| JP | 2016-148074 | 8/2016 |
| JP | 2016148074 | 8/2016 |
| KR | 2000-0035796 | 6/2000 |
| KR | 10-2006-0085676 | 7/2006 |
| KR | 10-2010-0108850 | 10/2010 |
| KR | 10-2011-0121283 | 11/2011 |
| KR | 10-2015-0060978 | 6/2015 |
| WO | 2005033367 | 4/2005 |
| WO | 2011040464 | 4/2011 |

* cited by examiner

【DRAWINGS】
【FIG. 1】
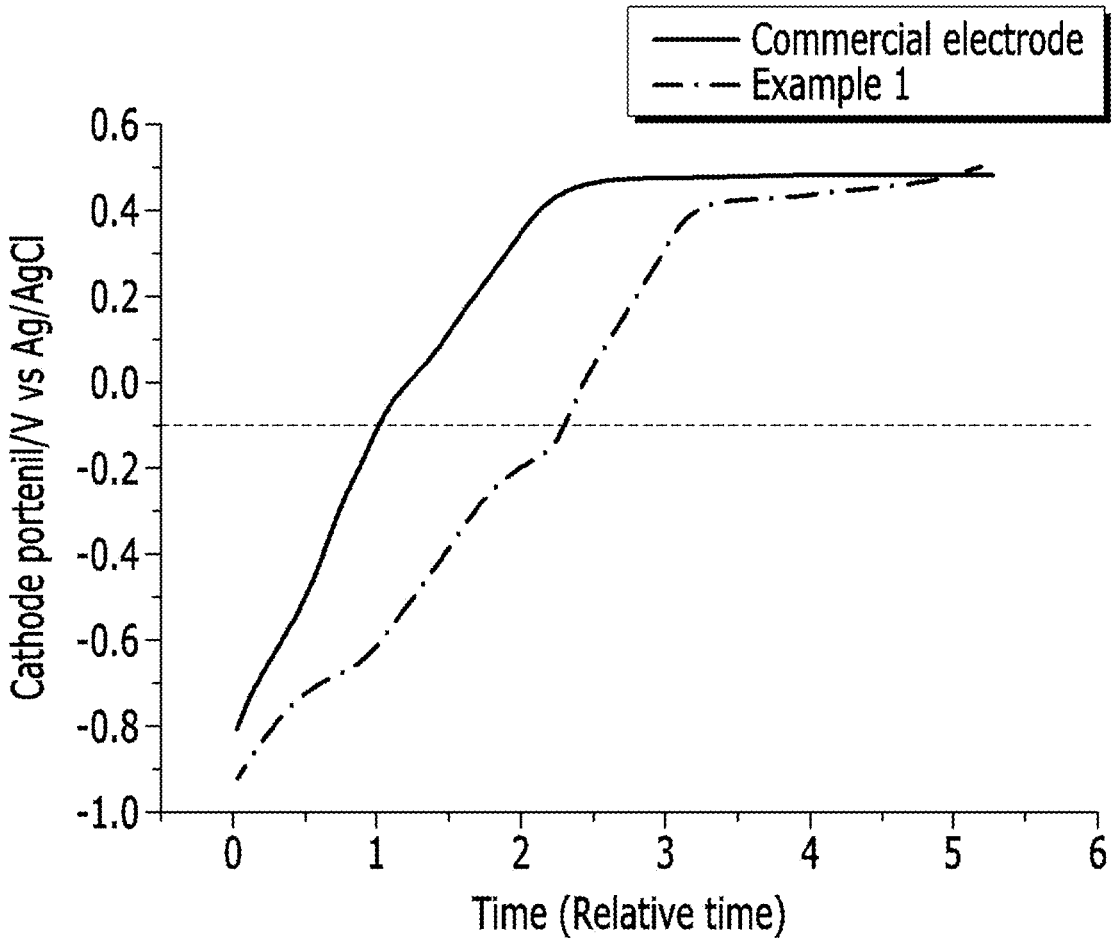

【FIG. 2】
2A
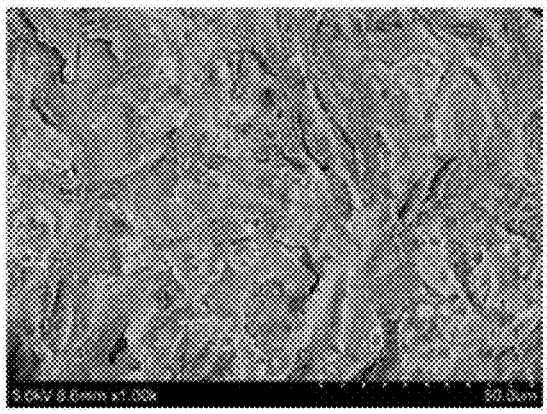
2B
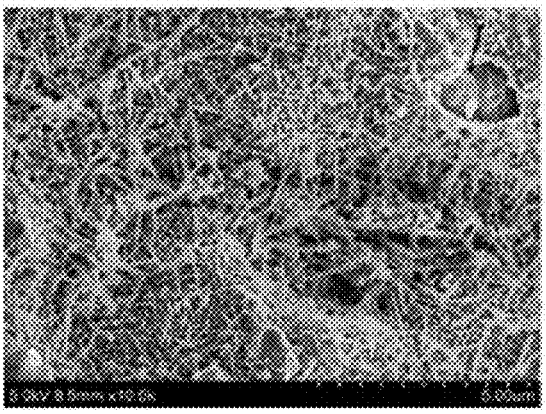
Example 1
2C
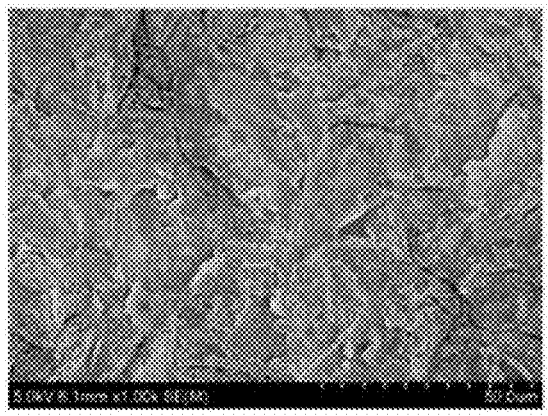
2D
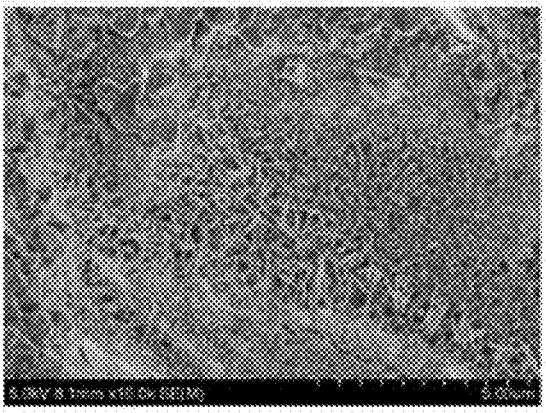
Example 2
2E
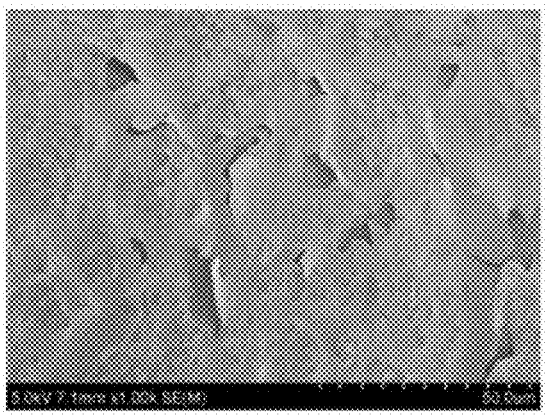
2F
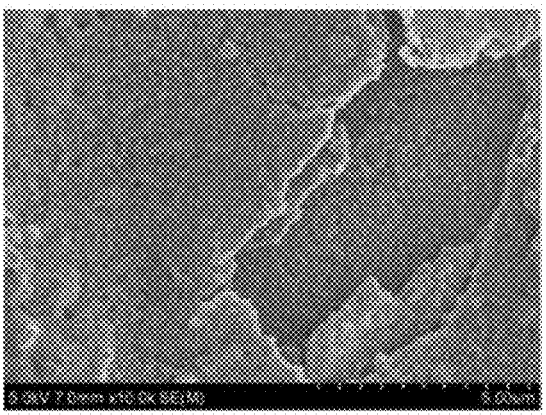
Comparative Example 1

ELECTRODE FOR ELECTROLYSIS AND PREPARATION METHOD THEREOF

CROSS-REFERENCE TO RELATED APPLICATION(S)

This application is a National Stage Application of International Application No. PCT/KR2018/008645 filed on Jul. 30, 2018, which claims the benefits of Korean Patent Application Nos. 10-2017-0102524 filed on Aug. 11, 2017 and 10-2018-0087750 filed on Jul. 27, 2018 with the Korean Intellectual Property Office, the disclosures of which are incorporated herein by reference in their entirety.

TECHNICAL FIELD

The present disclosure relates to an electrode for electrolysis and a preparation method of the same. More particularly, the present disclosure relates to an electrode for electrolysis that is capable of stabilizing an overvoltage value of the electrode for electrolysis and improving durability by increasing a needle-like structure, and a preparation method of the same.

BACKGROUND OF ART

The chlor-alkali process is a process to produce chlorine ($Cl_2$) and sodium hydroxide (NaOH) by electrolysis of salt water, which is industrially useful since it can mass-produce two materials that are widely used as basic materials in the petrochemical industry.

The chlor-alkali process is carried out in a chlor-alkali membrane or in a diaphragm electrolytic cell having an electrode for electrolysis containing an electrolytic catalyst. In the chlor-alkali process, an overvoltage must be applied to overcome various intrinsic resistances of a cell in addition to the theoretically required voltage. It is desirable to develop a method that minimizes the overvoltage requirement, since such overvoltage reduction will significantly save energy costs associated with cell operation.

As methods for reducing the overvoltage requirement of the electrolytic cell, several methods for reducing the overvoltage of the electrode have been proposed. In the case of a cathode, a conventionally used material such as mild steel, nickel, or stainless steel has an overvoltage of 300 to 400 mV. Accordingly, a method of activating the surface thereof has been proposed to reduce the overvoltage.

However, for the purpose of reducing the electrolysis voltage, it is necessary to further reduce the overvoltage. In addition, when the operation of the electrolytic cell suddenly stops due to an accident or a power failure, a reverse current by a reverse decomposition of electrolytic products may flow because the cathode and anode are electrically connected through a rectifier. In this case, there is a problem that the cathode activity deteriorates and the overvoltage efficiency decreases due to partial elution of the metal component of the cathode. Therefore, a method for minimizing the influence by the reverse current is also required.

In order to solve the above problems, various electrodes have been disclosed.

In JP-A-11-140680, an electrode material layer mainly composed of ruthenium oxide is formed on a metal substrate, and further a porous and low-active protective layer is formed on the surface thereof, thus improving the durability of the electrode.

In JP-A-11-229170, an electrodeposited nickel layer is provided in which ruthenium oxide is dispersed, and the surface of the layer is coated with a conductive oxide composed of titanium oxide, such that resistance to mercury poisoning is improved.

However, these methods have disadvantages in that they require additional raw materials, or it is difficult to set conditions and a complicated manufacturing process results, and there is a problem that durability of the electrode is not sufficient.

PRIOR ART DOCUMENTS

Patent Document 1: JP-A-11-140680
Patent Document 2: JP-A-11-229170

DETAILED DESCRIPTION OF THE INVENTION

Technical Problem

In order to solve the above problems, the present disclosure provides an electrode for electrolysis having a low overvoltage and excellent durability. In addition, the present disclosure provides a preparation method of an electrode for electrolysis which can prepare an electrode exhibiting the above effects without introducing additional precursors or changing manufacturing facilities.

Technical Solution

The present disclosure provides an electrode for electrolysis including a metal substrate, and a catalyst layer formed on the metal substrate, wherein the catalyst layer includes nitrogen, a platinum group metal and a rare earth metal, and a nitrogen content of the catalyst layer is 20 to 60 mol % based on the mol % of the platinum group metal.

Herein, the catalyst layer can include a needle-like structure of the rare earth metal, and the needle-like structure can include at least two needle-shaped structures each separately having a thickness of 50 to 300 nm and a length of 0.5 to 10 μm.

In addition, the present disclosure provides a preparation method of an electrode for electrolysis, including the steps of:

preparing a coating solution for preparing an electrode, the coating solution containing a platinum group metal precursor, a rare earth metal precursor, an organic solvent, and an amine-based solvent;

applying the coating solution for preparing an electrode on a metal substrate to form a catalyst layer;

drying the catalyst layer; and heat-treating the catalyst layer.

Herein, the platinum group metal precursor can be at least one selected from the group consisting of ruthenium chloride hydrate ($RuCl_3.nH_2O$), tetraamine platinum(II) chloride hydrate ($Pt(NH_3)_4Cl_2.H_2O$), rhodium chloride ($RhCl_3$), rhodium nitrate hydrate ($Rh(NO_3)_3.nH_2O$), iridium chloride hydrate ($IrCl_3.nH_2O$), and palladium nitrate ($Pd(NO_3)_2$).

In addition, the rare earth metal precursor can be at least one selected from the group consisting of cerium(III) nitrate ($Ce(NO_3)_3$), cerium(III) carbonate ($Ce_2(CO_3)_3$), cerium(III) chloride ($CeCl_3$), yttrium oxide ($Y_2O_3$), and yttrium carbonate ($Y_2(CO_3)_3$).

The organic solvent can be a mixed solvent of a C1 to C6 alcohol and a C4 to C8 glycol ether, and the ratio of the C1 to C6 alcohol to the C4 to C8 glycol ether can be 10:1 to 1:2.

The amine-based solvent can be a C6 to C30 saturated or unsaturated aliphatic amine, and can preferably be at least one selected from the group consisting of octylamine, decylamine, dodecylamine, oleylamine, laurylamine, and hexadecylamine. The amine-based solvent can be present in an amount of 3 to 40 vol % based on 100 vol % of the coating solution for preparing an electrode.

The platinum group metal precursor and the rare earth metal precursor can be present in a molar ratio of 1:1 to 10:1.

A concentration of the platinum group metal precursor and the rare earth metal precursor in the coating solution for preparing an electrode can be 50 to 150 g/L.

The drying step can be carried out at a temperature of 70 to 200° C., and the heat-treating step can be carried out at a temperature of 300 to 600° C.

Further, the present disclosure provides an electrode for electrolysis prepared by the method.

Advantageous Effects

The electrode for electrolysis according to the present disclosure has an improved needle-like structure of a rare earth metal compared to conventional electrodes, and thus detachment of catalytic materials from the electrode is reduced, so that the electrode is excellent in durability such as exhibiting stable performance even in a reverse current flow. Further, since the electrode for electrolysis of the present disclosure has a low overvoltage value, an overvoltage required amount of the electrolytic cell can be remarkably reduced. In addition, according to the preparation method of the present disclosure, an electrode for electrolysis having the above effects can be prepared without introducing additional precursors or changing manufacturing facilities.

BRIEF DESCRIPTION OF THE DRAWINGS

FIG. 1 shows evaluation results of durability for electrodes for electrolysis of Example 1 and a commercial electrode.

FIG. 2 shows SEM images of the surface of the electrode for electrolysis of Examples 1 (FIGS. 2A and 2B), Example 2 (FIGS. 2C and 2D) and Comparative Example 1 (FIGS. 2E and 2F) after cell operation.

DETAILED DESCRIPTION OF THE EMBODIMENTS

The terms used in this description are just for explaining exemplary embodiments, and are not intended to restrict the present invention. The singular expression may include the plural expression unless it is differently expressed contextually. It must be understood that the term "include", "equip", or "have" in the present description is only used for designating the existence of characteristics, steps, components, or combinations thereof, and does not exclude the existence or the possibility of addition of one or more different characteristics, steps, components, or combinations thereof beforehand.

The present invention may be variously modified and have various forms, and specific examples of the present invention will be explained below. However, it is not intended to limit the present invention to the specific examples, and it must be understood that the present invention includes all modifications, equivalents, or replacements within the spirit and technical scope of the present invention.

Hereinafter, the present invention will be described in more detail.

The present disclosure provides an electrode for electrolysis including a metal substrate and a catalyst layer formed on the metal substrate, wherein the catalyst layer includes nitrogen, a platinum group metal, and a rare earth metal, and a nitrogen content of the catalyst layer is 20 to 60 mol % based on mol % of the platinum group metal.

In the electrode for electrolysis of the present disclosure, the catalyst layer can be prepared by including an amine-based solvent, and thus nitrogen is included in the catalyst layer. The electrode for electrolysis of the present disclosure having a needle-like structure developed by using the amine-based solvent exhibits excellent durability and thus has an advantage that stable performance can be realized even in a reverse current flow. Also, the above-mentioned electrode has an effect of improving the overvoltage value as compared with conventional commercial electrodes.

Herein, the nitrogen content of the catalyst layer is preferably 35 mol % or more, or 40 mol % or more, and 55 mol % or less, or 50 mol % or less, based on the mol % of the platinum group metal. If the nitrogen content based on the mol % of the platinum group metal is less than 20 mol % or 60 mol % or more, it may be difficult to secure the durability-improving effect of the electrode.

In the present disclosure, any metal substrate having electrical conductivity commonly used in the art can be used without limitation.

The type of the metal substrate is not particularly limited. For example, a porous substrate such as a mesh, a nonwoven metal fabric, a metal foam, a porous punching plate, a braided metal, an expanded metal, or the like can be used.

The material of the metal substrate can be nickel, a nickel alloy, stainless steel, copper, cobalt, iron, steel, or an alloy thereof. Nickel or a nickel alloy is preferable in terms of electrical conductivity and durability.

The platinum group metal refers to a transition metal of Group 8 to Group 10 that is similar in properties to platinum, including ruthenium (Ru), platinum (Pt), rhodium (Rh), iridium (Ir), osmium (Os), and palladium (Pd). The platinum group metal has catalytic activity, and can lower the overvoltage and improve life characteristics by being included in the electrode for electrolysis. According to one embodiment of the present disclosure, the platinum group metal can be ruthenium.

The rare earth metal refers to cerium (Ce), yttrium (Y), lanthanum (La), scandium (Sc), or the like. According to one embodiment of the present disclosure, the rare earth metal can be cerium.

Meanwhile, the catalyst layer may include a needle-like structure of the rare earth metal. The needle-like structure refers to a structure including two or more needle-like structures (needle-shaped structures). When the needle-like structure of the rare earth metal is developed in the catalyst layer, it can support the platinum group metal, which is an electrode catalyst material, so that detachment of the platinum group metal from the electrode is reduced. Therefore, electrode performance is not deteriorated even under the reverse current condition and excellent durability is exhibited.

Specifically, the material forming the needle-like structure can have a thickness of 50 nm to 300 nm, or 50 to 200 nm, and a length of 0.5 to 10 μm, or 0.5 to 5 μm. As will be described in the experimental examples, the electrode for electrolysis of the present disclosure is prepared by including an amine-based solvent, so that the needle-like structure of the rare earth metal is developed in the catalyst layer, thereby exhibiting stable electrode characteristics and durability as compared with conventional electrodes for electrolysis.

In addition, the present disclosure provides a preparation method of an electrode for electrolysis, including the steps of:

preparing a coating solution for preparing an electrode, the coating solution containing a platinum group metal precursor, a rare earth metal precursor, an organic solvent, and an amine-based solvent;

applying the coating solution for preparing an electrode on a metal substrate to form a catalyst layer;

drying the catalyst layer; and heat-treating the catalyst layer.

The electrode for electrolysis prepared according to the present disclosure significantly improves the overvoltage and exhibits an effect of increasing the needle-like structure of the rare earth metal on the surface of the electrode during cell operation. Accordingly, the electrode has remarkably improved durability, so that stable overvoltage efficiency can be ensured even after a reverse current phenomenon occurs.

In the present disclosure, the coating solution for preparing an electrode contains at least one platinum group metal precursor and at least one rare earth metal precursor.

In the present disclosure, the platinum group metal precursor can be a salt or an oxide of the platinum group metal. Herein, the salt or the oxide can be in the form of a hydrate.

For example, the platinum group metal precursor can be at least one selected from the group consisting of ruthenium chloride hydrate ($RuCl_3.nH_2O$), tetraamine platinum(II) chloride hydrate ($Pt(NH_3)_4Cl_2.H_2O$), rhodium chloride ($RhCl_3$), rhodium nitrate hydrate ($Rh(NO_3)_3.nH_2O$), iridium chloride hydrate ($IrCl_3.nH_2O$), and palladium nitrate ($Pd(NO_3)_2$).

The platinum group metal precursor is calcined in the heat-treating step and converted into catalytically active particles, that is, metal or compound particles that are catalytically active for the reduction of water. When the platinum group metal or compound is contained in the electrode, an effect of improving the electrode overvoltage can be obtained.

The rare earth metal precursor is a salt or an oxide containing the rare earth metal described above. Specifically, the rare earth metal precursor can be at least one selected from the group consisting of cerium(III) nitrate ($Ce(NO_3)_3$), cerium(III) carbonate ($Ce_2(CO_3)_3$), cerium(III) chloride ($CeCl_3$), yttrium oxide ($Y_2O_3$), and yttrium carbonate ($Y_2(CO_3)_3$), but the present disclosure is not limited thereto.

The salt or the oxide can be in the form of a hydrate. For example, cerium nitrate 6 hydrate, cerium carbonate 5, 8, or 9 hydrate, cerium chloride 1, 3, 6, or 7 hydrate, yttrium carbonate 3 hydrate, and the like can be used.

The rare earth metal precursor is calcined in the heat-treating step and converted into a rare earth metal oxide. The granular form of the rare earth metal oxide has insufficient hydrogen-generating activity, but changes from a granular form to a needle-like form under an environment in which hydrogen is generated. This needle-like form supports the catalyst layer of the platinum group compound and has an effect of reducing the detachment of the catalyst layer.

It was confirmed that the needle-like structure of the rare earth metal oxide significantly increased during cell operation in the electrode for electrolysis prepared according to the present disclosure as compared with the electrode prepared by conventional methods. Accordingly, the electrode for electrolysis of the present disclosure exhibits excellent durability such as stably maintaining the electrode performance even after a reverse current occurs.

Preferably, in the present disclosure, the rare earth metal precursor includes at least one cerium (Ce) salt or oxide. According to a preferred embodiment of the present disclosure, cerium nitrate hexahydrate ($Ce(NO_3)_3.6H_2O$) can be used as the rare earth metal precursor, and ruthenium chloride hydrate ($RuCl_3.nH_2O$) can be used as the platinum group metal precursor.

A ratio of the platinum group metal precursor and the rare earth metal precursor is not particularly limited, and can be appropriately adjusted depending on the kind of the precursor. The platinum group metal precursor and the rare earth metal precursor can be used in a molar ratio of 1:1 to 10:1, or 3:1 to 10:1 in order to optimize catalytic activity of the finally prepared electrode for electrolysis.

In the present disclosure, the solvent used in the coating solution for preparing an electrode is an organic solvent capable of dissolving the platinum group metal precursor and the rare earth metal precursor, and is preferably a solvent capable of volatilizing at least 95% in the drying and heat-treating steps.

For example, the organic solvent can be an organic polar solvent such as an alcohol-based solvent, a glycol ether-based solvent, an ester-based solvent, or a ketone-based solvent, and any of these can be used alone or in combination. Preferably, the organic solvent can be an alcohol-based solvent, a glycol ether-based solvent, or a combination thereof.

The alcohol-based solvent is preferably a C1 to C6 alcohol, and specifically, at least one selected from the group consisting of methanol, ethanol, propanol, isopropyl alcohol, butanol, ethylene glycol, and propylene glycol, can be used, but the present disclosure is not limited thereto.

The glycol ether-based solvent is preferably a C4 to C8 glycol ether, and specifically, at least one selected from the group consisting of 2-ethoxyethanol, 2-propoxyethanol, 2-isopropoxyethanol, 2-butoxyethanol, and 2-(2-methoxyethoxy) ethanol, any of which can be used, but the present disclosure is not limited thereto.

In one embodiment of the present disclosure, the organic solvent can be a mixed solvent of a C1 to C6 alcohol and a C4 to C8 glycol ether. When the mixed solvent is used, there is an effect of significantly reducing peeling and cracking of the prepared electrode as compared with an electrode prepared using only a single alcohol-based solvent. Further, since the drying time is prolonged in a large-area coating, more uniform coating can be performed, which is preferable.

In order to ensure the above effect, the mixing ratio of the C1 to C6 alcohol and the C4 to C8 glycol ether is preferably in the range of 10:1 to 1:2, more preferably in the range of 4:1 to 1:1. In one embodiment of the present disclosure, a 1:1 mixed solvent of isopropyl alcohol and 2-butoxyethanol, or a 1:1 mixed solvent of ethanol and 2-butoxyethanol, is used as the organic solvent, but the present disclosure is not limited thereto.

In the present disclosure, the coating solution for preparing an electrode further contains an amine-based solvent as a stabilizer in addition to the organic solvent. When the amine-based solvent is included in the coating solution, the finally prepared electrode has the increased needle-like structure of the rare earth metal on the surface during cell operation, thereby improving durability of the electrode and further reducing the overvoltage of the electrode.

The amine-based solvent can be a C6 to C30 saturated or unsaturated aliphatic amine, and the type thereof is not particularly limited. For example, at least one selected from the group consisting of octylamine, decylamine, dodecylamine, oleylamine, laurylamine, and hexadecylamine can be used. Alternatively, the amine-based solvent can be octylamine, oleylamine, or a combination thereof.

In the present disclosure, the amine-based solvent is present in an amount of 3 to 40 vol %, or 5 to 30 vol %, based on 100 vol % of the coating solution for preparing an electrode. If the amount of the amine-based solvent is less than 3 vol %, the durability-improving effect and the overvoltage-reducing effect of the electrode cannot be achieved. If it exceeds 40 vol %, it is difficult to dissolve the metal precursors, and a coating solution for preparing an electrode in which the precursors are uniformly dispersed cannot be obtained.

In the present disclosure, the preparation method of the coating solution for preparing an electrode is not particularly limited. For example, a method in which a platinum group metal precursor and a rare earth metal precursor are added and dissolved in a mixed solvent obtained by mixing an organic solvent and an amine-based solvent can be used. Alternatively, in order to facilitate dissolution of the metal precursors, the coating solution can be prepared by completely dissolving the metal precursors in an organic solvent and then adding an amine-based solvent with mixing.

Herein, the final concentration of the platinum group metal precursor and the rare earth metal precursor in the coating solution for preparing an electrode may be 50 to 150 g/L, or 80 to 120 g/L. When the concentration is within these ranges, the content of the metal precursors in the coating solution becomes sufficient to ensure the electrode performance and durability, and the coating solution can be coated on the substrate with an appropriate thickness, thereby maximizing the process efficiency.

Subsequently, the coating solution for preparing an electrode is applied on a metal substrate to form a catalyst layer, which is then dried and heat-treated to prepare an electrode for electrolysis. Herein, the metal substrate can be subjected to a cleaning treatment such as degreasing and blasting, or a surface-roughening treatment before forming the catalyst layer to further improve adhesion to the catalyst layer.

Further, in order to form an electrode having an appropriate thickness, the applying, drying, and heat-treating steps of the coating solution can be repeated several times.

The method of applying the coating solution for preparing an electrode is not particularly limited, and coating methods known in the art such as spray coating, paint brushing, doctor blade, dip-drawing, spin coating, and the like can be used.

The drying step is carried out to remove the solvent contained in the catalyst layer. The drying condition is not particularly limited, and can be appropriately adjusted depending on the type of the solvent and the thickness of the catalyst layer. For example, the drying step can be carried out at a temperature of 70 to 200° C. for 5 to 15 minutes.

Subsequently, a heat-treating step for calcining the metal precursor is performed.

In the heat-treating step, pyrolysis of the platinum group metal precursor and the rare earth metal precursor in the catalyst layer takes place, thereby converting into a platinum group metal, a compound thereof, and a rare earth metal oxide having catalytic activity.

The heat-treating condition can vary depending on the kind of the metal precursors, but specifically, the heat-treating temperature can be 300 to 600° C. or 400 to 550° C., and the heat-treating can be performed for 10 minutes to 2 hours.

When the electrode is prepared by repeating the applying, drying, and heat-treating steps one or more times as described above, the heat-treating step performed after the applying and drying steps is shortened to 5 to 15 minutes, and the final heat-treating step performed after the last drying step can be carried out for a sufficient time of 30 minutes or more, or 1 to 2 hours. When the final heat-treating step is performed for a long time, the metal precursors can be completely pyrolyzed, and the interface between the catalyst layers can be minimized, thereby improving the electrode performance.

The thickness of the catalyst layer in the electrode for electrolysis prepared by the above method is not particularly limited, but can be in the range of 0.5 to 5 μm, or 1 to 3 μm.

The electrode for electrolysis prepared according to the preparation method of the present disclosure can be applied to various electrolytic cells for industrial electrolysis, and can be suitably used as a cathode of a chlor-alkali cell.

Hereinafter, the present invention will be described in more detail with reference to the following preferred examples, but these examples are provided for illustrative purposes only. It is apparent to those skilled in the art that various changes and modifications can be made within the scope and spirit of the present invention. Therefore, it is obvious that the changes and modifications are within the scope of the present invention.

EXAMPLES

Example 1

A precursor solution was prepared by dissolving a metal precursor containing $RuCl_3.nH_2O$ and $Ce(NO_3)_2.6H_2O$ in a molar ratio of 6:1 in a mixed solvent of isopropyl alcohol (IPA) and 2-butoxy ethanol in a volume ratio of 1:1. Subsequently, the precursor solution and an amine-based solvent (oleylamine) were mixed in a volume ratio of 2:1 to prepare a coating solution for preparing an electrode at a concentration of 100 g/L. The coating solution was brush-coated on a nickel mesh, dried at 200° C. for 10 minutes, and heat-treated at 500° C. for 10 minutes. This process was repeated ten times in total, and then it was heat-treated at 500° C. for 1 hour to obtain an electrode for electrolysis.

Example 2

An electrode for electrolysis was prepared in the same manner as in Example 1, except that octylamine was used instead of oleylamine as an amine-based solvent.

Comparative Example 1

A coating solution with a concentration of 100 g/L was prepared by dissolving a metal precursor containing $RuCl_3.nH_2O$ and $Ce(NO_3)_2.6H_2O$ in a molar ratio of 6:1 in a mixed solvent of isopropyl alcohol (IPA) and 2-butoxy ethanol in a volume ratio of 1:1. The coating solution was brush-coated on a nickel mesh, dried at 200° C. for 10 minutes, and heat-treated at 500° C. for 10 minutes. This process was repeated ten times in total, and then it was heat-treated at 500° C. for 1 hour to obtain an electrode for electrolysis.

Comparative Example 2

A precursor solution was prepared by dissolving a metal precursor containing $RuCl_3.nH_2O$ and $Ce(NO_3)_2.6H_2O$ in a molar ratio of 6:1 in a mixed solvent of isopropyl alcohol (IPA) and 2-butoxy ethanol in a volume ratio of 1:1. Subsequently, oxalic acid was added thereto as an additional additive so that a molar ratio of oxalic acid to ruthenium was 0.5 times, and dissolved to prepare a coating solution with a concentration of 100 g/L. The coating solution was brush-coated on a nickel mesh, dried at 200° C. for 10 minutes, and heat-treated at 500° C. for 10 minutes. This process was repeated ten times in total, and then it was heat-treated at 500° C. for 1 hour to obtain an electrode for electrolysis.

Preparation Example

A half-cell having the electrode for electrolysis (10 mm×10 mm) of the above examples or comparative examples as a cathode was prepared by the following method. The half-cell was prepared using the electrode of the examples or comparative examples as a cathode and 32 wt % NaOH aqueous solution as an electrolyte, a Pt wire as a counter electrode, and a saturated calomel electrode (SCE) as a reference electrode.

Experimental Example 1: Evaluation of the Degree of Overvoltage Improvement

The voltage at a current density of 4.4 kA/m2 was measured for each electrode for electrolysis by linear sweep voltammetry using the half-cell of the above preparation example. The above experiment was repeated 10 times, and an average value of the measured voltages was determined as an average value of overvoltage improvement. The degree of overvoltage improvement was calculated by comparing with the voltage of the commercial electrode (Asahi Kasei commercial cathode: ncz-2).

<LSV Test Conditions>

Size of electrode: 10 mm×10 mm, temperature: 90° C., electrolyte: 32 wt % NaOH aqueous solution Pretreatment of a sample (electrode for electrolysis): Electrolyzed to generate hydrogen for 1 hour at a current density of −6 A/cm$^2$.

Initial potential (V): −500.0 e$^{-3}$

Final potential (V): −1.500.0 e$^{0}$

Scan rate (V/s): 10.0 e$^{-3}$

Sample period (V): 1.0 e$^{-3}$

TABLE 1

| Electrode | Commercial electrode (mV) (@ 4.4 kA/m$^2$) | Average value of overvoltage improvement (mV) (@ 4.4 kA/m$^2$) | Degree of overvoltage improvement (mV) (@ 4.4 kA/m$^2$) |
|---|---|---|---|
| Example 1 | −1.120 | −1.069 | −51 |
| Example 2 | −1.120 | −1.065 | −55 |
| Comparative Example 1 | −1.120 | −1.086 | −34 |
| Comparative Example 2 | −1.120 | −1.110 | −10 |

As shown in Table 1, Example 1 prepared by adding oleylamine as an amine-based solvent has the average degree of overvoltage improvement compared with the commercial electrode of −51 mV, which shows that Example 1 is superior to Comparative Example 1 prepared without addition of the amine-based solvent, and Comparative Example 2 prepared by adding oxalic acid instead of the amine-based solvent. In addition, the electrode of Example 2 prepared by adding octylamine as an amine-based solvent exhibited the degree of overvoltage improvement of −55 mV.

From the above results, it can be confirmed that when an amine-based solvent is included in the coating solution for preparing an electrode, an electrode having a better overvoltage-improving effect can be prepared under the same process conditions as conventionally used.

Experimental Example 2: Evaluation of Durability

The half-cell of the above preparation example was subjected to a reverse current test under the following test conditions to evaluate durability against the electrode of Example 1 and the commercial electrode (same as Experimental Example 1). The results are shown in Table 2 and FIG. 1.

<Reverse Current Test Conditions>

Size of electrode: 10 mm×10 mm, temperature: 90° C., electrolyte: 32 wt % NaOH aqueous solution Pretreatment of a sample: Electrolyzed to generate hydrogen for 20 minutes at a current density of −0/1 A/cm$^2$, for 3 minutes at −0.2 A/cm$^2$ and −0.3 A/cm$^2$, respectively, and for 30 minutes at −0.4 A/cm$^2$.

Reverse current condition: +0.05 kA/m$^2$

TABLE 2

| Electrode | Relative time taken to reach −0.1 V (based on commercial electrode) |
|---|---|
| Commercial electrode | 1 |
| Example 1 | 2.29 |

In the reverse current test, the time taken to reach −0.1 V at which electrolysis of the active layer occurs was checked, and it was confirmed that the electrode of Example 1 (2.31 hours) took 2.29 times longer than the commercial electrode (1.01 hours).

From the above results, it can be confirmed that the electrode prepared according to the present disclosure has an advantage in durability as compared with the commercial electrode even in reverse current flow.

Experimental Example 3: Comparison of Surface Structures of Electrodes

The cell in which the test of Experimental Example 1 was completed was disassembled and the surface states of the electrodes of Examples 1 and 2 and Comparative Example 1 were confirmed by SEM at 1000 times and 10,000 times, respectively (FIGS. 2A-2F). The thickness and length of the needle-like structure were measured by a length measurement tool of SEM.

Referring to FIG. 2, it can be confirmed that Example 1 (FIGS. 2A and 2B) and Example 2 (FIGS. 2C and 2D), in which an amine-based solvent was added to the precursor solution for preparing an electrode, had a needle-like structure of cerium clearly observed on the surface of the electrode after cell operation as compared to Comparative Example 1 (FIGS. 2E and 2F) in which no amine-based solvent was added.

Specifically, in the case of Example 1, each needle-like structure was formed to have a thickness of 50 to 200 nm and a length of 0.5 to 5 μm, whereas in Comparative Example 1, the thickness was only 20 to 50 nm and the length was 0.2 to 0.5 μm. That is, it can be confirmed that the needle-like structure of cerium was increased by 2 to 4 times in the electrode to which amine was added.

In addition, no peeling or cracking was observed in Examples 1 and 2, whereas peeling and cracking occurred on the surface of the electrode of Comparative Example 1.

From the above results, it can be confirmed that the preparation method of the present disclosure can increase the needle-like structure of the rare earth metal, thereby significantly improving durability of the electrode.

Experimental Example 4: Comparison of Surface Components of Electrodes

The components of the electrodes prepared in Examples 1 and 2 and Comparative Example 1 were measured by EDX (Energy Dispersive Spectrometer). Three measurements were made at different points of each electrode, and mol % of Ru and N in the electrode is shown in Table 3 below.

TABLE 3

| Electrode | Ru in the electrode (mol %) | N in the electrode (mol %) | N/Ru × 100 (mol %) |
|---|---|---|---|
| Example 1 | 17 | 8 | 47 |
| | 23 | 8 | 35 |
| | 26 | 9 | 35 |
| Example 2 | 17 | 7 | 41 |
| | 17 | 7 | 41 |
| | 16 | 8 | 50 |
| Comparative Example 1 | 26 | 5 | 19 |
| | 45 | 6 | 13 |
| | 24 | 4 | 16 |

As a result of measurement, in the case of Example 1 and 2 using an amine-based solvent in the preparation of the electrode for electrolysis, the molar ratio of nitrogen to ruthenium was as high as 35 to 50%, whereas in Comparative Example 1 in which amine was not used had a molar ratio of nitrogen to ruthenium of 13 to 19%.

From the above results, it can be confirmed that the electrode prepared according to the method of the present disclosure exhibits a higher content of nitrogen, which is an amine component, even after the heat-treatment, than the electrode not containing an amine-based solvent during preparation.

The invention claimed is:

1. A preparation method of an electrode for electrolysis, comprising the steps of:

preparing a coating solution for preparing an electrode by:

dissolving a platinum group metal precursor and a rare earth metal precursor in an organic solvent that is a mixed solvent comprising a C1 to C6 alcohol and a C5 to C8 glycol ether in a volume ratio of from 2:1 to 1:1 to yield a precursor solution;

mixing the precursor solution and an amine-based solvent comprising a C6 to C30 unsaturated aliphatic amine to yield the coating solution;

applying the coating solution on a metal substrate to form a catalyst layer;

drying the catalyst layer; and heat-treating the catalyst layer, wherein the catalyst layer comprises a needle-like structure of the rare earth element.

2. The method of claim 1, wherein the platinum group metal precursor is at least one selected from the group consisting of ruthenium chloride hydrate ($RuCl_3.nH_2O$), tetraamine platinum(II) chloride hydrate ($Pt(NH_3)_4Cl_2.H_2O$), rhodium chloride ($RhCl_3$), rhodium nitrate hydrate ($Rh(NO_3)_3.nH_2O$), iridium chloride hydrate ($IrCl_3.nH_2O$), and palladium nitrate ($Pd(NO_3)_2$).

3. The method of claim 1, wherein the rare earth metal precursor is at least one selected from the group consisting of cerium(III) nitrate ($Ce(NO_3)_3$), cerium(III) carbonate ($Ce_2(CO_3)_3$), cerium(III) chloride ($CeCl_3$), yttrium oxide ($Y_2O_3$), and yttrium carbonate ($Y_2(CO_3)_3$).

4. The method of claim 1, wherein the amine-based solvent is oleylamine.

5. The method of claim 1, wherein the platinum group metal precursor and the rare earth metal precursor are present in a molar ratio of 1:1 to 10:1.

6. The method of claim 1, wherein the amine-based solvent is present in an amount of 3 to 40 vol % based on 100 vol % of the coating solution.

7. The method of claim 1, wherein a total concentration of the platinum group metal precursor and the rare earth metal precursor in the coating solution is 50 to 150 g/L.

8. The method of claim 1, wherein the drying step is carried out at a temperature of 70 to 200° C.

9. The method of claim 1, wherein the heat-treating step is carried out at a temperature of 300 to 600° C.

10. The method of claim 1, wherein the drying step is carried out at a temperature of 200° C. for 5 to 15 minutes.

11. The method of claim 1, wherein:

the platinum group metal precursor that is at least one selected from the group consisting of ruthenium chloride hydrate ($RuCl_3.nH_2O$), rhodium chloride ($RhCl_3$), rhodium nitrate hydrate ($Rh(NO_3)_3.nH_2O$), iridium chloride hydrate ($IrCl_3.nH_2O$), and palladium nitrate ($Pd(NO_3)_2$);

the rare earth metal precursor is at least one selected from the group consisting of cerium(III) nitrate ($Ce(NO_3)_3$), cerium(III) carbonate ($Ce_2(CO_3)_3$), cerium(III) chloride ($CeCl_3$), yttrium oxide ($Y_2O_3$), and yttrium carbonate ($Y_2(CO_3)_3$); and the platinum group metal precursor and the rare earth metal precursor are present in a molar ratio of 3:1 to 10:1.

* * * * *